US005422023A

United States Patent [19]

Francisco

[11] Patent Number: 5,422,023

[45] Date of Patent: Jun. 6, 1995

[54] CORROSION INHIBITOR FOR AVIATION TURBINE OILS (PNE-628)

[75] Inventor: Manuel A. Francisco, Washington, N.J.

[73] Assignee: Exxon Research and Engineering Company, Florham Park, N.J.

[21] Appl. No.: 135,212

[22] Filed: Oct. 12, 1993

[51] Int. Cl.[6] ..... C10M 133/58

[52] U.S. Cl. ..... 252/47; 252/56 R; 252/56 D

[58] Field of Search ..... 252/47, 56 R, 56 D

[56] References Cited

U.S. PATENT DOCUMENTS

| | | | |
|---|---|---|---|
| 2,542,542 | 2/1951 | Lippincott | 252/56 D |
| 2,543,964 | 3/1951 | Giammaria | 252/56 D |
| 2,570,788 | 10/1951 | Giammaria | 252/56 D |
| 3,663,561 | 5/1972 | Blaha | 252/47 |
| 3,859,218 | 1/1975 | Jervis et al. | 252/32.5 |
| 4,045,376 | 8/1977 | Rubin et al. | 252/56 S |
| 4,136,043 | 1/1979 | Davis | 252/47.5 |
| 4,871,465 | 10/1989 | Hutchison | 252/47 |
| 4,948,523 | 8/1990 | Hutchison et al. | 252/47 |

FOREIGN PATENT DOCUMENTS 0310366 9/1987 European Pat. Off. .

*Primary Examiner*—Prince Willis, Jr.
*Assistant Examiner*—Cephia D. Toomer
*Attorney, Agent, or Firm*—James H. Takemoto

[57] ABSTRACT

A lubricating oil composition for jet engines which comprises: (a) an aviation turbine oil; (b) from about 0.025 to about 5.0 wt %, based on lubricating oil composition, of a dimercaptothiadiazole of the formula:

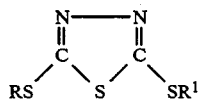

(I)

where R and $R^1$ are each independently hydrogen or hydrocarbyl radical having from 1 to 20 carbon atoms; and (c) from about 1.0 to about 30.0 wt %, based on lubricating oil composition, of an alphaolefin/maleic ester copolymer of the formula

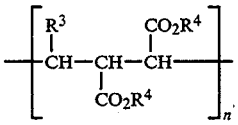

(II)

where $R^3$ and $R^4$ are each independently $C_1$ to $C_{18}$ alkyl, and n is an integer such that the average molecular weight of the copolymer is from 500 to 20,000.

8 Claims, No Drawings

CORROSION INHIBITOR FOR AVIATION TURBINE OILS (PNE-628)

BACKGROUND OF THE INVENTION

1. Field Of The Invention

This invention relates to a lubricant composition containing a polymer as corrosion inhibitor and its use as a corrosion inhibitor in aviation turbine oils.

DESCRIPTION OF THE RELATED ART

Jet engines operate under conditions which require that lubricants perform at high temperatures. The temperatures are such that natural lubricating oils are not suitable for use in jet engines. Current original equipment manufacturer and military specifications require that aviation turbine oils meet a number of stringent performance requirements. New jet engines place increased demands on aviation turbine oils, particularly with regard to their load bearing the properties. Many load bearing (extreme pressure) additives have drawbacks when used in aviation turbine oils due to the extreme operating conditions and stringent specifications which such oils must meet.

It is known that dimercaptothiadiazoles increase the load carrying capacity and antiwear properties of lubricating oils. However, under the extreme operating conditions of jet engines, dimercaptothiadiazoles tend to be corrosive to metal parts containing copper, silver, nickel or their alloys. It would be desirable to have a corrosion inhibitor which would allow the use of dimercaptothiadiazoles in lubricating oils under extreme operating conditions while at the same time protecting from corrosion resulting from their use.

SUMMARY OF THE INVENTION

This invention provides a lubricating oil composition for jet engines which comprises:

a) an aviation turbine oil;

b) from about 0.025 to about 5.0 wt %, based on lubricating oil composition, of a dimercaptothiadiazole of the formula

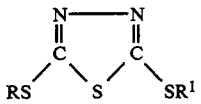

(I)

where R and $R^1$ are each independently hydrogen or hydrocarbyl radical having from 1 to 20 carbon atoms; and (c) from about 1.0 to about 30.0 wt %, based on lubricating oil composition, of an alpha-olefin/maleic ester copolymer of the formula

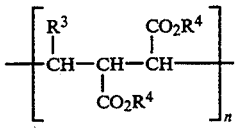

(II)

where $R^3$ and $R^4$ are each independently $C_1$ to $C_{18}$ alkyl, and n is an integer such that the average molecular weight of the copolymer is from 500 to 20,000. Another aspect of the invention includes a method for reducing corrosion in jet engines which comprises lubricating the jet engine with an aviation turbine oil containing a dimercaptothiadiazole of the formula (I) and an alphaolefin/maleic ester copolymer of the formula (II). Yet another aspect of the invention includes a lubricating oil composition which comprises a lubricating oil basestock, from about 0.025 wt % to about 5.0 wt %, based on oil composition of a dimercaptohiadiazole of the formula (I) and from about 1.0 to about 30.0 wt %, based on oil composition, of an alphaolefin/maleic ester copolymer of the formula (II).

DESCRIPTION OF THE PREFERRED EMBODIMENTS

The lubricating oil compositions utilize a major amount of lubricating oil basestock and minor amounts of dimercaptothiadiazole and copolymer. For lubricating oil for jet engines, the lubricating oil basestock include aviation turbine oils. Because of the high performance demands of aviation turbine oils, such oils are generally synthetic lubricating oils.

The lubricating oil basestock can be derived from natural lubricating oils, synthetic lubricating oils, or mixtures thereof. In general, the lubricating oil basestock will have a kinematic viscosity ranging from about 5 cSt to about 10,000 cSt at 40° C., although typical applications will require an oil having a viscosity ranging from about 10 cSt to about 1,000 cSt at 40° C.

Natural lubricating oils include animal oils, vegetable oils (e.g., castor oil and lard oil), petroleum oils, mineral oils, and oils derived from coal or shale.

One suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid, and the like.

Esters useful as synthetic oils also include those made from linear or branched $C_5$ to $C_{12}$ monocarboxylic acids and polyols and polyol ethers such as neopentyl glycol, trimethylolpropane, pentaerythritol, dipentaerythritol, tripentaerythritol, pentaerythritol monoethylether, and the like. This class of synthetic oils is particularly useful as aviation turbine oils. Especially preferred esters for use as aviation turbine oils include the linear or branched $C_5$ to $C_{12}$ monocarboxylic acid esters of trimethylolpropane, pentaerythritol and dipentaerythritol.

In the dimercaptothiadiazoles of the formula (I), R and $R^1$ are preferably hydrogen or R is hydrogen and $R^1$ is $C_1$ to $C_{12}$ alkyl which may be linear or branched. Examples of preferred dimercaptothiadiazoles include 2,5-dimercapto-1,3,4-thiadiazole wherein the alkyl is methyl, butyl, octyl or dodecyl. Such dimercaptothiadiazoles are commercially available from R. T. Vanderbilt, Co., Norwalk, Conn.

Alpha-olefin/maleic ester copolymers of the formula (II) are also commercially available from AKZO Chemical Company under the tradename Ketjenlube ®. Such copolymers are prepared by the catalytic copolymerization of alpha-olefin and maleic anhydride followed by esterification with an alkanol. In copolymers of the formula (II), $R^3$ if preferably hydrogen or $C_1$ to $C_6$ alkyl and $R^4$ is preferably $C_1$ to $C_8$ alkyl. The molecular weight range is preferably from about 500 to 5000.

The lubricant oil compositions may be prepared by blending aviation turbine oil, dimercaptothiadiazole of the formula (I) and alpha-olefin/maleic ester copolymer of the formula (II). Preferred amounts of dimercaptothiadiazole are from about 0.05 to about 1.0 wt %, based on lubricant oil composition, and preferred amounts of copolymer are from about 5.0 to about 15.0 wt %, based on lubricant oil composition. The balance of the oil composition is aviation turbine oil.

If desired, other additives known in the art may be added to the lubricating oil basestock. Such additives include dispersants, other antiwear agents, antioxidants, rust inhibitors, other corrosion inhibitors, detergents, pour point depressants, other extreme pressure additives, viscosity index improvers, friction modifiers, hydrolytic stabilizers and the like. These additives are typically disclosed, for example, in "Lubricant Additives" by C. V. Smalhear and R. Kennedy Smith, 1967, pp. 1-11 and in U.S. Pat. No. 4,105,571, the disclosures of which are incorporated herein by reference.

A lubricating oil containing dimercaptothiadiazole and copolymer according to the invention acid can be used in essentially any application where wear protection, extreme pressure activity and/or friction reduction is required. Thus, as used herein, "lubricating oil" (or "lubricating oil composition") is meant to include aviation lubricants, automotive lubricating oils, industrial oils, gear oils, transmission oils, and the like. In addition, the lubricating oil composition of this invention can be used in the lubrication system of essentially any internal combustion engine, including automobile and truck engines, two-cycle engines, aviation piston engines, marine and railroad engines, and the like. Also contemplated are lubricating oils for gas-fired engines, alcohol (e.g., methanol) powered engines, stationary powered engines, turbines, and the like. Of particular interest is the use in aviation turbine oils for jet engines.

This invention may be further understood by reference to the following example.

EXAMPLE

This example demonstrates the corrosion protection provided by the lubricating oil composition according to this invention. The corrosion test is the Rolls Royce 1002B test which is described as follows.

The Rolls Royce 1002B test is conducted at 200° C. for 192 hours. During the tests, the desired load additive in a fully formulated oil is contacted with a series of metal coupons which are different for each test. There is no air bubbling during the test. The surface of the test formulation is in contact with the atmosphere and there is no agitation. The metals are carefully cleaned and weighed prior to the start of each test. When the test is complete, the metal coupons are visually inspected for surface corrosion, cleaned and weighed.

The aviation turbine oil tested contained a pentaerythritol ester as basestock, 2,5-dimercapto-1,3,4-thiadiazole, ketjenlube 165 ® which is a copolymer purchased from AKZO Chemical Co. and has an average molecular weight of about 3000, and a standard additive package containing antioxidant, metal passivator and corrosion inhibitor. The results are shown in Table 1.

TABLE 1

| Test | Additive Amount (wt %) DMTD (a) | Ketjenlube 165 ® | Copper Corrosion (b) | Nickel Corrosion (b) | Silver Corrosion (b) |
|---|---|---|---|---|---|
| 1 | 0.05 | 0.00 | −0.018 | −0.014 | −0.21 |
| 2 | 0.05 | 5 | 0.00 | 0.0714 | 0.007 |

(a) 2,5-dimercapto-1,3,4-thiadiazole
(b) in milligrains/square centimeter

The results of Test 1 without the Ketjenlube ® copolymer shows that there is a weight loss in the metal coupon due to corrosion by the turbine oil being tested. If the Ketjenlube ® copolymer is present, no weight loss is observed.

What is claimed is:

1. A method for reducing corrosion in jet engines which comprises lubricating the jet engine with a lubricating oil composition which comprises:

(a) an aviation turbine oil;

(b) from about 0.025 to about 5.0 wt % based on lubricating oil composition, of a dimercaptothiadiazole of the formula:

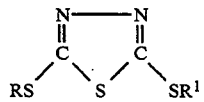

(I)

where R and $R^1$ are each independently hydrogen or hydrocarbyl radical having from 1 to 20 carbon atoms; and (c) from about 5.0 to about 15.0 wt %, based on lubricating oil composition, of an alpha-olefin/maleic ester copolymer of the formula:

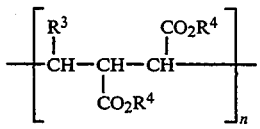

(II)

where $R^3$ and $R^4$ are each independently $C_1$ to $C_{18}$ alkyl, and n is an integer such that the average molecular weight of the copolymer is from 500 to 20,000.

2. The method of claim 1 wherein the aviation turbine oil is a synthetic oil.

3. The method of claim 2 wherein the synthetic oil is a $C_5$ to $C_{12}$ monocarboxylic acid ester of trimethylopropane, pentaerythritol and dipentaerythritol.

4. The method of claim 1 wherein R and $R^1$ are hydrogen.

5. The method of claim 1 wherein R is hydrogen and $R^1$ is $C_1$ to $C_{12}$ alkyl.

6. The method of claim 1 wherein $R^3$ is hydrogen or $C_1$ to $C_6$ alkyl.

7. The method of claim 1 wherein $R^4$ is $C_1$ to $C_8$ alkyl.

8. The method of claim 1 wherein the average molecular weight of the copolymer is from about 500 to about 5,000.

* * * * *